US007744091B2

(12) United States Patent
Berke et al.

(10) Patent No.: US 7,744,091 B2
(45) Date of Patent: Jun. 29, 2010

(54) IDENTITY GUESSING GAME AND METHODS OF PLAYING

(76) Inventors: Alana Berke, 31 W. 60th St., Downers Grove, IL (US) 60516; Eileen Berke, 111 E. Chestnut, #34A, Chicago, IL (US) 60611

( * ) Notice: Subject to any disclaimer, the term of this patent is extended or adjusted under 35 U.S.C. 154(b) by 186 days.

(21) Appl. No.: 11/751,374

(22) Filed: May 21, 2007

(65) Prior Publication Data

US 2007/0273101 A1 Nov. 29, 2007

Related U.S. Application Data

(60) Provisional application No. 60/801,806, filed on May 19, 2006.

(51) Int. Cl.
*A63F 3/00* (2006.01)

(52) U.S. Cl. ..... 273/429

(58) Field of Classification Search ..... 273/429–432, 273/302, 308

See application file for complete search history.

(56) References Cited

U.S. PATENT DOCUMENTS 4,315,627 A * 2/1982 Schlegel et al. ..... 273/249
4,566,698 A * 1/1986 Sneden ..... 273/249
4,679,796 A * 7/1987 Rein ..... 273/236
4,964,642 A * 10/1990 Kamille ..... 273/240
4,993,718 A * 2/1991 Dandridge et al. ..... 273/249
5,054,775 A * 10/1991 Banks et al. ..... 273/431
5,112,057 A * 5/1992 Popovic ..... 273/243
5,121,928 A * 6/1992 Salerno-Sonneberg ..... 273/243
5,195,753 A 3/1993 Brukl et al.
5,197,884 A 3/1993 Roemer, Jr. et al.
5,207,435 A 5/1993 Tanner
5,484,287 A 1/1996 Concepcion-Diaz
5,738,354 A * 4/1998 Easley ..... 273/249
6,267,376 B1 7/2001 Jenkins (Continued)

OTHER PUBLICATIONS http://www.syl.com/articles/whointheworldamipartygame.html, Who in the World Am I Party Game, Jun. 2007.*

(Continued)

*Primary Examiner*—William M Pierce
(74) *Attorney, Agent, or Firm*—Lempia Braidwood LLC

(57) ABSTRACT

An identity guessing game includes a plurality of identities to be guessed. Each identity is provided on a media in a manner permitting selection of one identity by a player for a round of play. The game also includes a plurality of clue sets, each clue set having multiple clues relating to a respective one of the identities. Each clue within each clue set is provided on a media so as to be presentable one at a time to a player during the round of play. A game can be played by selecting or providing a first identity to be guessed and a first set of clues each relating to the first identity. A first player is presented with at least one clue of the first set of clues. The first player can then determine whether to guess the first identity and move to the next step or to be presented with another of the first set of clues. The first player guesses the first identity when all of the first set of clues have been presented or when the first player decides to guess the first identity having been presented fewer than the entire first set of clues.

13 Claims, 7 Drawing Sheets

U.S. PATENT DOCUMENTS

| | | | | |
|---|---|---|---|---|
| 6,328,308 | B1 | 12/2001 | Kirby | |
| 6,409,171 | B1 * | 6/2002 | Schultz et al. | 273/245 |
| 6,497,412 | B1 | 12/2002 | Bramm | |
| 6,520,504 | B2 | 2/2003 | Loder | |
| 6,702,291 | B2 | 3/2004 | Grebler et al. | |
| 6,752,396 | B2 | 6/2004 | Smith | |
| 6,863,606 | B1 | 3/2005 | Berg et al. | |
| 7,007,952 | B2 | 3/2006 | Nelson | |

OTHER PUBLICATIONS http://www.amazon.com/Name-Game-Celebrity-Guessing/dp/0811844595, The Name Game: The Celebrity Guessing Game, Oct. 2004.* http://boardgamegeek.com/boardgame/1468, Anybody's Guess Board Game, 1990.*

* cited by examiner

IDENTITY GUESSING GAME AND METHODS OF PLAYING

RELATED APPLICATION DATA

This patent relates to and claims priority benefit of U.S. provisional application Ser. No. 60/801,806, which was filed on May 19, 2006, which was entitled "Identity Guessing Game and Methods of Playing," and the entirety of which is incorporated herein by reference.

BACKGROUND OF THE INVENTION

1. Field of the Disclosure

The present disclosure is generally directed to games, and more particularly to an identity guessing game and methods of playing the game.

2. Description of Related Art

Guessing games and trivia games are known in the art. These games often include cards, a game board, or both. The cards or the game board often offer a correct answer, one or more clues, one or more questions, and/or a plurality of selectable answers from which players can chose in order to determine the correct answer. The players will typically hear or read the information and try to guess the correct answer. A limitation of most of these types of games is that a relatively small maximum number of players can play the game at any given time. This limitation results from a fixed number of game board positions, game tokens, and/or cards that are available to play the game. Many of these games also require the players to learn a complex set of rules of play.

Guessing games are also known in the art. One such game is available for play on the internet. A player enters a website and is asked to choose a secret identity of a celebrity. A computer program is designed to ask the player a number of YES or NO questions. Upon compiling the answers, the program then guesses the players secret identity. This game is located at www.student.com under the address http://guess-thecelebrity.student.com.

Another identity guessing game is known as "Times UP!" and is available from R&R Games. This game is a party game played by multiple players formed in teams. A deck of cards is provided with celebrities identified on the cards. The game is played in rounds. In a first round, the deck is passed around from team to team. Each team has a time limit with the deck on each turn. Clue-givers on each team give clues and teammates try to guess the identity of the celebrity on a given card. No clues are provided on the cards as a part of the game. Each team keeps the cards for the celebrities that they guess correctly. The deck is passed until the cards are gone and the team with the most cards wins the round. Successive rounds are played in a similar fashion, but the clue-givers become more limited in what they can say and do while offering clues.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The games and playing methods disclosed herein are for guessing an identity based on a succession of clues. The disclosed games can include guessing the identity of a person, place, or thing. Scores can be tallied in order to determine a winner of each game and/or to determine the success rate of an individual player's guessing attempts. The game playing methods can be used for competitive fun or for educational purposes. In one example, the disclosed games and playing methods can be played at a party, during a social event, or in a classroom using a plurality of cards and score sheets. In another example, the disclosed games and playing methods can be played on the internet by accessing a game playing website. In yet another example, the disclosed games and playing methods can be provided on an electronic media such as a compact disc (CD) or digital video disc (DVD) for downloading to a computer or to another type of electronic device or can be provided on the drive or memory of an electronic device.

A number of the disclosed games and playing methods allow the players to move about and to mix and mingle with other players. Using the disclosed games and playing methods, the number of players permitted to play a given game can be significantly less limited than prior art games. The disclosed games and playing methods permit a game to be played over an indefinite period of time or within a finite time limit, as desired.

Figure 1:
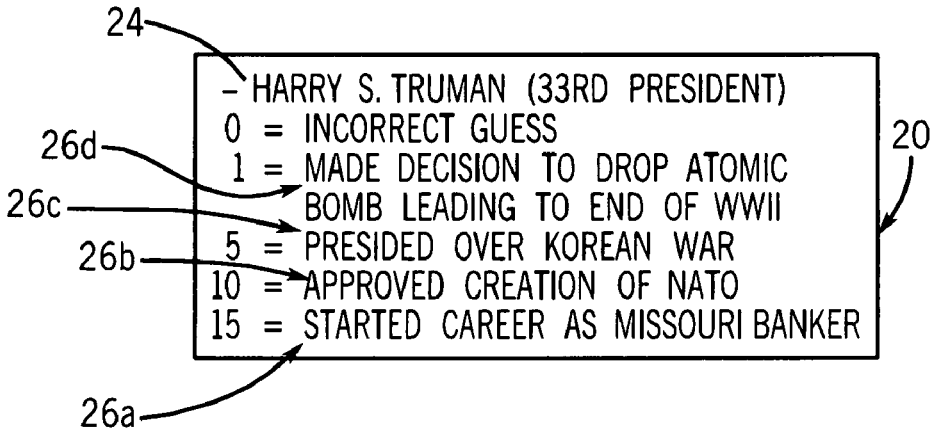
FIG. 1 shows one example of a game playing card in accordance with the teachings of the present invention.
Figure 2:
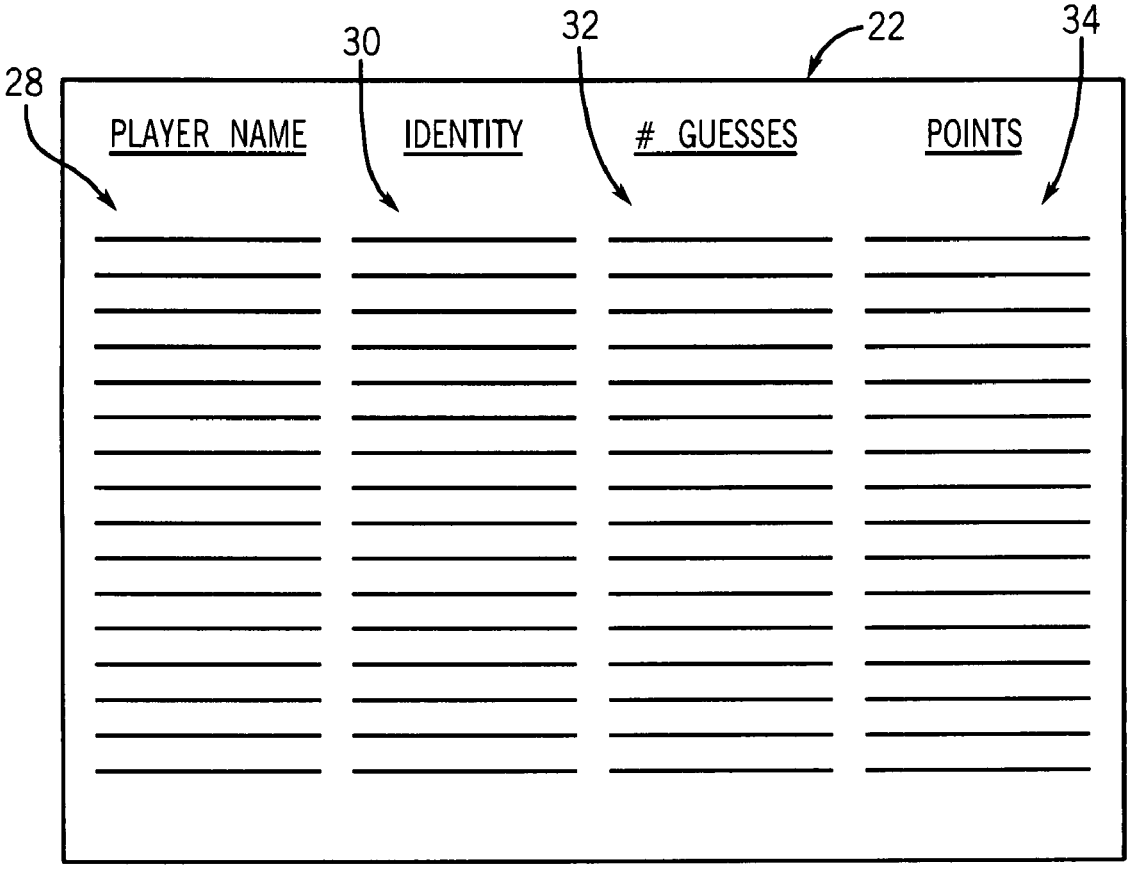
FIG. 2 shows one example of a score sheet for use with the playing card shown in FIG. 1 .
Figure 3:
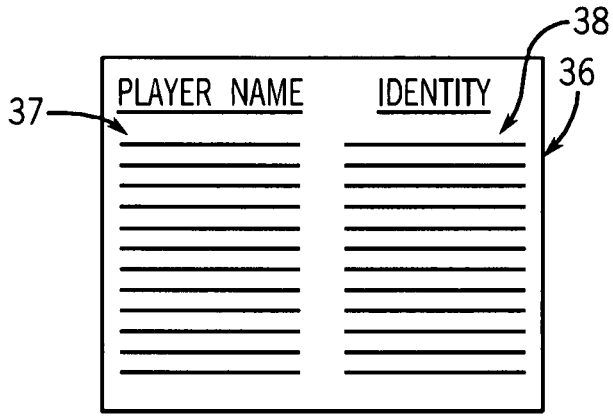
FIG. 3 shows another example of a score sheet for use with the playing card of FIG. 1.

In one example shown in FIGS. 1-3, a game and playing methods according to the present invention utilize a plurality of cards 20 and a plurality of score sheets 22. In this example, each card 20 includes an identity 24 and a plurality of clues 26*a*, 26*b*, 26*c*, 26*d*, etc, which relate to the identity 24 on the particular card 20. Reference herein to the clues generally is done employing a reference number, such as 26 in this example. Reference herein to a particular clue on a given media is done employing the reference number in combination with a letter, such as 26*a*, 26*b*, 26*c*, and 26*d* in this example. Also, the number of clues provided for a given identity can vary from 2 to any suitable number greater than 2, as desired. The number of clues can depend upon the particular type of game and playing method for which the card 20 or other media, as described below, are being utilized.

In this example, the clues 26 can be arranged on each card 20 in order of increasing specificity, importance, or likelihood to assist player's in guessing the identity 24 on the card. Each clue 26*a,* 26*b,* 26*c,* 26*d,* etc. is also assigned a number of points in this example. The number of points can be the same for each clue, and can be added to or subtracted from a point total during play to alter the number of points earned. Alternatively, the number of points can become progressively larger or smaller for each clue in comparison to the number of points assigned to each preceding clue on a card 20. For example, the first clue 26*a* can be the least specific clue relevant to the identity 24 and is assigned 15 points. The second clue 26*b* can be more specific to the identity 24 and is assigned 10 points. The third clue 26*c* in this example can be even more specific to the identity 24 and is assigned 5 points. The fourth and final clue 26*d* can be even more specific to the identity 24 and is assigned 1 point. The card 20 notes that zero (0) points can be awarded for an incorrect guess made after all four clues 26*a,* 26*b,* 26*c,* and 26*d* are given. In a simpler form of the game, a points system need not be used or provided at all.

In the disclosed example, one player holds a card 20, which has the identity 24 and clues 26 on the same side of the card 20. The player will not show their card 20 to any of the other players, but will instead read the clues 26, one at a time, to one or more players seeking to determine the identity 24. As is discussed below, a number of playing methods can be employed using the cards 20 in this example.

The cards 20 can be provided as one bulk set or can be provided in subsets for different identity categories, subjects, and the like. The identities in a given set of cards can vary considerably and yet fall within the spirit and scope of the present invention. In one example, a set of cards can be provided with identities being the Presidents of the United States, with one President and corresponding clues to their identity provided on each card in the set.

FIG. 1 shows one example of the card 20 noting the identity 24 as Harry S. Truman and listing four clues 26 as to his identity. The identities 24 on the cards 20 can be virtually any type of person, place, or thing. A few examples of the virtually unlimited, myriad other possible identity card sets include, but are certainly not limited to, celebrities, sports stars, cities, countries, mountains, water bodies, planets, household objects, historical people, historical eras, animals, chemicals, politically or historically significant occurrences, movie trivia, fictional characters, authors, automobiles, science facts, or the like. The list of potential identities is virtually limitless. New, current, and updated card sets can also be created and provided as time passes and as new identities become significant or desirable. Thus, a game according to the present invention can be updated from time to time.

Different sets of cards can be offered in one game pack so that the games do not become old or stale. A large number of cards can be provided in each set with each card in the set related to the same identity subset so that a large number of players can play one form of the game at the same time. If 50 cards are provided in one set, 50 players could play one form of the game, each by taking on the identity of a selected one of the cards.

FIGS. 2 and 3 show two examples of score sheets that can be provided and utilized with the cards 20 depicted in FIG. 1 and described above. In one example as shown in FIG. 2, score sheets 22 can be provided that have four columns. A first column 28 can include a line for writing down the name of a game player. Each game player can select one card 20 and take on the identity 24 of the card during play. Each other player can thus be identified by name on one player's score sheet to identify the other players with which the one player has had contact during play. The second column 30 can include the one player's guesses as to the identity 24 on the card 20 of each of the other players listed in the first column 28. The third column 32 can indicate the number of guesses taken before writing down the guessed identity in the second column 30 for each of the listed players of the first column 28. A fourth column 34 can also be used to write down the number of points earned, based on the number of guesses in the third column 32 needed to guess a correct identity 24, as discussed in greater detail below.

Another example of a score sheet 36 as depicted in FIG. 3 and has a simpler form. The score sheet 36 can be used with the cards 20, but ignoring the points system, or can be used with cards that have no point system. The score sheet 36 is suited for a game that does not employ a point system, whether or not the cards include points assigned to each clue. In this example, the score sheet 36 only includes two columns. A first column 37 is provided for the name of the other players and a second column 38 is provided for writing down each of the identity guesses for the listed players in the first column 37. In one example, the game can be sold with cards 20 including points and with a stack of both score sheets 22 and 36. Young kids can play the game using the score sheets 36 and older kids and adults can play the game using the score sheets 22 and apply the points system.

In one example, the disclosed cards 20 and score sheets 22 or 36 can be passed out to individuals at a party, during a social gathering, or in a classroom to encourage the participants to meet one another and to provide entertainment while doing so. To promote mingling among players and provide a mechanism for name introductions, each player can also carry a score sheet 22 or 36. The score sheets 22 and 36 in the disclosed examples each have one column for a player to write down the name of every other player with whom they have made contact during the game. Thus, each person is encouraged to introduce themselves to and interact with others during play. The game components in this example are simple and yet can result in a fun experience and also promote the desired effect, such as meeting strangers at a party or meeting new classmates and learning new things.

Figure 4:
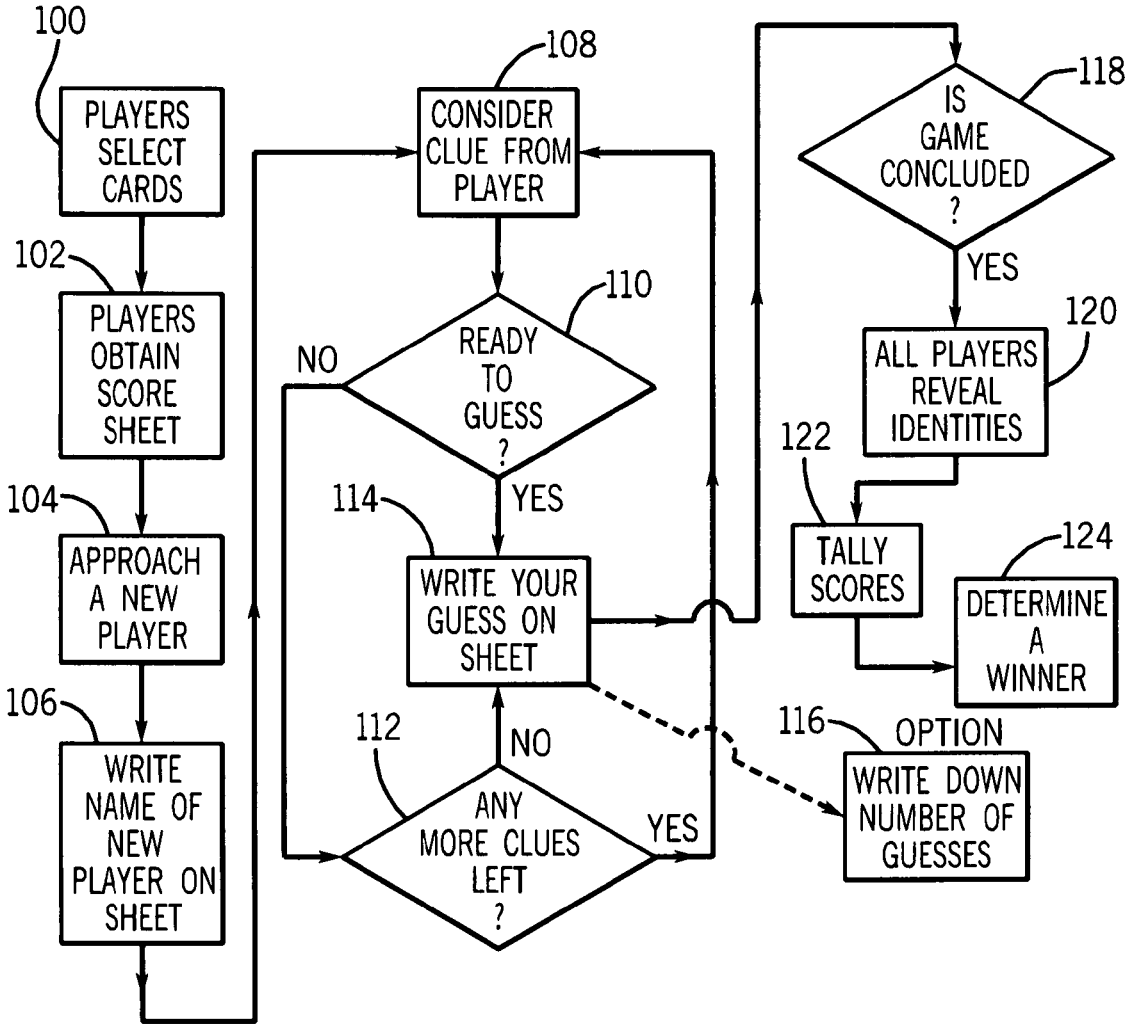
FIG. 4 is a flow chart showing one example of a method of playing a game using the card and sheets of FIGS. 1-3.

FIG. 4 is a flow chart representing one example of a method of playing a game using a plurality of cards like the card 20 and a plurality of score sheets like the score sheet 22 of FIGS. 1 and 2. The method of FIG. 4 is particularly well suited for lay at parties and during larger social events, but can also certainly be played in other social situations such as in a classroom or the like. To begin, a player holds one identity card 20 and a blank score sheet 22. Players mingle with one another as the game progresses. The object is to talk to as many players as possible, verbally obtain their clues, and guess their identity. After hearing enough clues or all the available clues, the player writes down the name of the other player and their possible identity. In this example, the player can also write down the number of clues used to make each guess.

With reference to FIG. 4, this example of a method of playing the game includes the players each selecting a card 20 as indicated at block 100 and obtaining a score sheet 22, as indicated at block 102. The players then begin to approach one another, as indicated at block 104. The players introduce themselves so that each player can add the name of the other to their score sheet, as indicated at block 106. One player takes a turn guessing, so the other player provides a first clue 26*a* to the player, as indicated at block 108. Upon receiving the clue, the player can then decide whether to try and guess the identity 24 of the other player or to request another clue, such as 26*b,* as indicated at block 110. If another clue is desired, the other player will either provide an additional clue or indicate that no more clues are available to be given, as indicated at block 112. If another clue is available, the one player can consider the next clue 26*b* and then decide if they are ready to guess the identity of the other player or if they would like yet another clue 26*c*, as indicated at blocks 108 and 110. If no other clues are available or if the player is now ready to guess the identity of the other player, the one player makes their guess and adds it to their score sheet 22 by the name of the other player, as indicated at block 114.

Though not directly noted in FIG. 4, the two players can reverse roles and the other player can receive clues and guess the identity of the one player as well. In this example, the players can also write down on their score sheet the number of clues required to make their guess as to the identity of each other player, as indicated at block 116. The players can then continue the game by approaching other players, as indicated at blocks 118 and 104, or the game can conclude based on a time limit or after all of the other guests have been approached and added to the score sheet of the players, as indicated at block 118. Upon termination of the game, all of the players can reveal their identities to the other players, as indicated at block 120. Then each player can tally their own score or someone else can tally all of the scores by determining the number of points for each correct guess and then totaling the number of points for each score sheet, as indicated at block 122. An overall winner can then be determined by identifying the player with the most points, as indicated at block 124 in this example.

The highest point winner in this example can obtain the most number of points by getting the most correct answers, by getting a relatively high number of correct answers using fewer guesses, or a combination. In other examples, the points system can be set up so that the fewest number of points wins the game. Alternatively, another type of point calculation method can be employed to determine a winner.

Certainly, the method can vary from that described herein, and minor changes and alterations to the method can be made without departing from the spirit and scope of the present invention. For example, the game can be terminated after a set amount of time, or at the end of the event, party, school class, or other gathering. The players can then share the correct identities and add up the number of their correct guesses as a group or separately. The game can be simplified by using the score sheets 36 without allotting points or taking into account the number of guesses. The most correct guesses can be used to determine a winner. The highest percentage of correct guesses can also be used to determine who wins, if the game is played deducting points for incorrect guesses. Alternatively, a combination of both could be used.

As will be evident to those having ordinary skill in the art, the games and playing methods in the example of FIGS. 1-4 described above can vary and yet fall within the spirit and scope of the present invention. For example, a game can be played where the identities are from different or random subsets or card sets to make the guessing more difficult and the game more challenging. Various time limits can be set over the game's duration to change the game dynamic. The games can be played in teams of two or more people. Teams can be specified as being made up of complete strangers or other groupings to promote a desired game or social outcome or effect.

Individual players can play the game by themselves as a learning tool and/or just see how well they can do guessing identities based on clues. In such an example, a different, alternative set of cards can be provided with clues on one side and the identity on the other so that the individual player can look at the clues without being able to see the identity. In another example played by multiple players, the guessed answers can be verbally provided back to the clue-giver instead of being written down on a score sheet. As will be evident to those having ordinary skill in the art, the game and score keeping methods can vary without departing from the scope and spirit of the present invention.

One ideal setting for playing the game disclosed and described above would be a social event with any number of participants. The above disclosed methods of play encourage one-on-one social contact between attendees/players at the gathering. During play, the game could continue simultaneously with other social discourse at a particular gathering and facilitate communication between players by requiring guests/players to mingle. The disclosed game can act as an "ice-breaker" among newly-introduced players. This might be particularly helpful in a classroom of new students or at a gathering of new members within an organization. The identities and clues can be germane to the group, the organization, or the like, as well as to make the game more interesting and relevant. Additionally, the disclosed score sheets 22 and 36, which employ writing down the name of each player as one meets them, encourage and assist the participants to remember the names of the players attending the event, thereby functioning as a memory aid.

Figure 5:
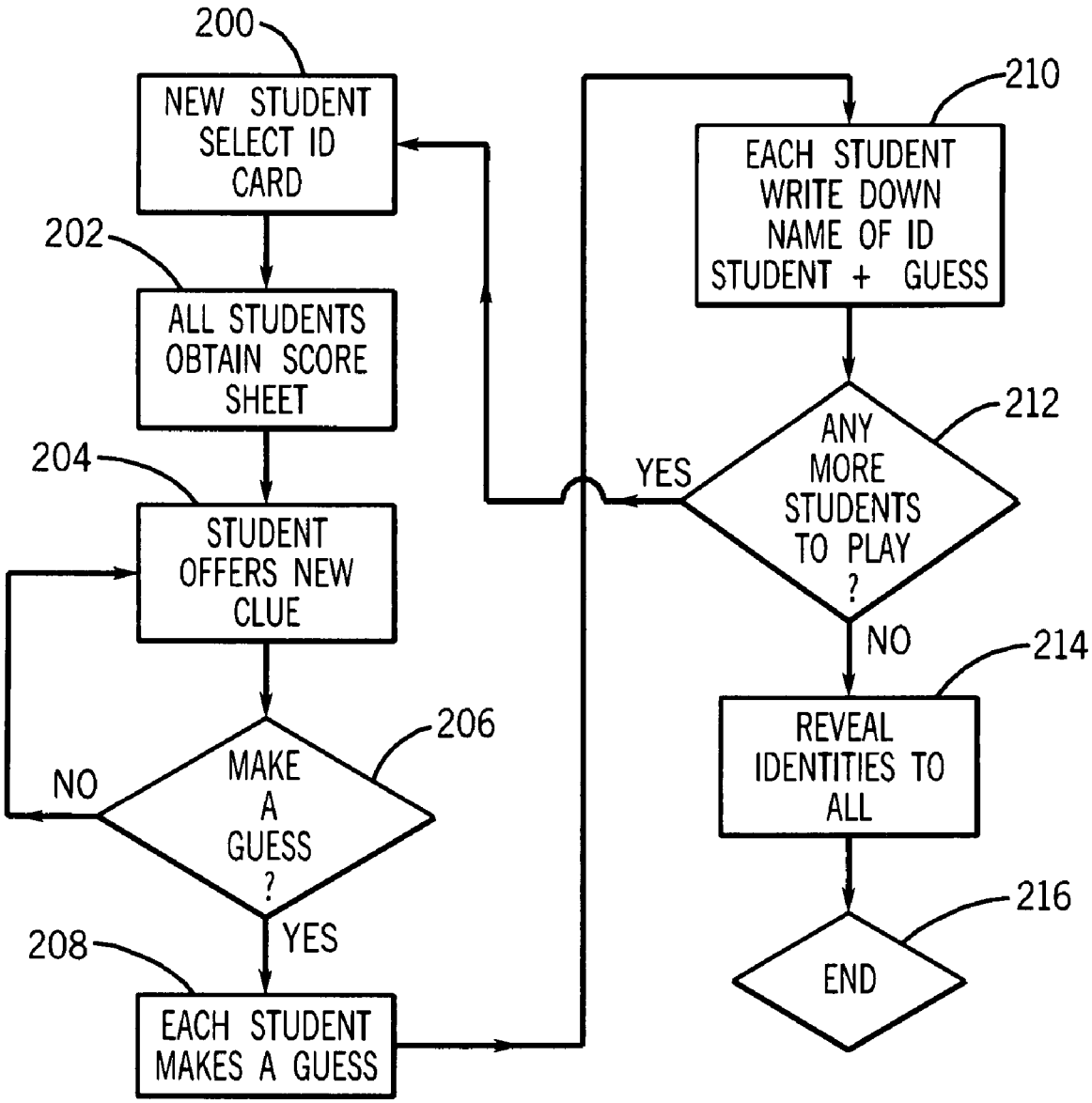
FIG. 5 is a flow chart showing another example of a method of playing a game using the cards and sheets of FIGS. 1-3.

As noted above, the game method can also be employed in a classroom setting for educational purposes. The game can be played in the classroom using the methods described above. Alternatively, the game can be played either in the classroom or at a social gathering as noted above where an individual presents clues to multiple people and all of those people try to guess the answer simultaneously. Referring to FIG. 5, one student in a class can select an identity card 20 per block 200 from a selected educational category suitable for the particular course of study. In one example, each student can acquire a score sheet, such as a sheet 36 per block 202. In another example, the class need not use any score sheets and the game can be played orally as a fun educational game.

The student or teacher can then offer a first clue 26*a* per block 204. Upon receiving the clue, each student in the class can then decide to try and guess the identity 24 or to request another clue, such as 26*b*, as indicated at block 206. If another clue is requested and available, the student can provide the next clue returning to block 204. If no more clues are available, the student can ask the class to make their guesses per block 208. If another clue 26b is available, the class can consider the next clue and then again determine if they are ready to guess the identity or to request another clue per block 206. Once the class is ready or is required to make a guess, the students can make their guesses per block 208 and then write them down on their sheets 36 next to the name of the student providing the clues per block 210. The student can then reveal their identity to the class. Alternatively, the class can move on to the next student per block 212 and a next identity per block 200 and then all of the identities can be revealed, per block 214, after each class member has had a chance to take on an identity 26 from a card 20 and to give the clues 26 to the class.

As before, the game can terminate per block 216 at a time limit, an end of an identity category, a predetermined number of categories, after each student has played a card, or the like. Also as with the other examples, scores in this example can be determined per block 214 and can simply be the number of correct guesses for each student. Alternatively, the number of guesses for each student and for each identity can be used as well. Other scoring or even grading methods can also be utilized. In another example, the teacher can be the clue provider for each identity and the entire class can make their guesses for each identity. The disclosed games and game playing methods can be particularly well suited for use as a fun and entertaining educational aid.

A set of simple instructions or rules for play can be provided with each game pack or with each set of cards and/or score sheets. Supplemental or refill score sheets and/or card sets can also be separately provided so that a consumer can enhance, renew, and/or update a previously obtained game pack. The set of rules can provide various other alternate or different methods of play if desired.

Figure 6:
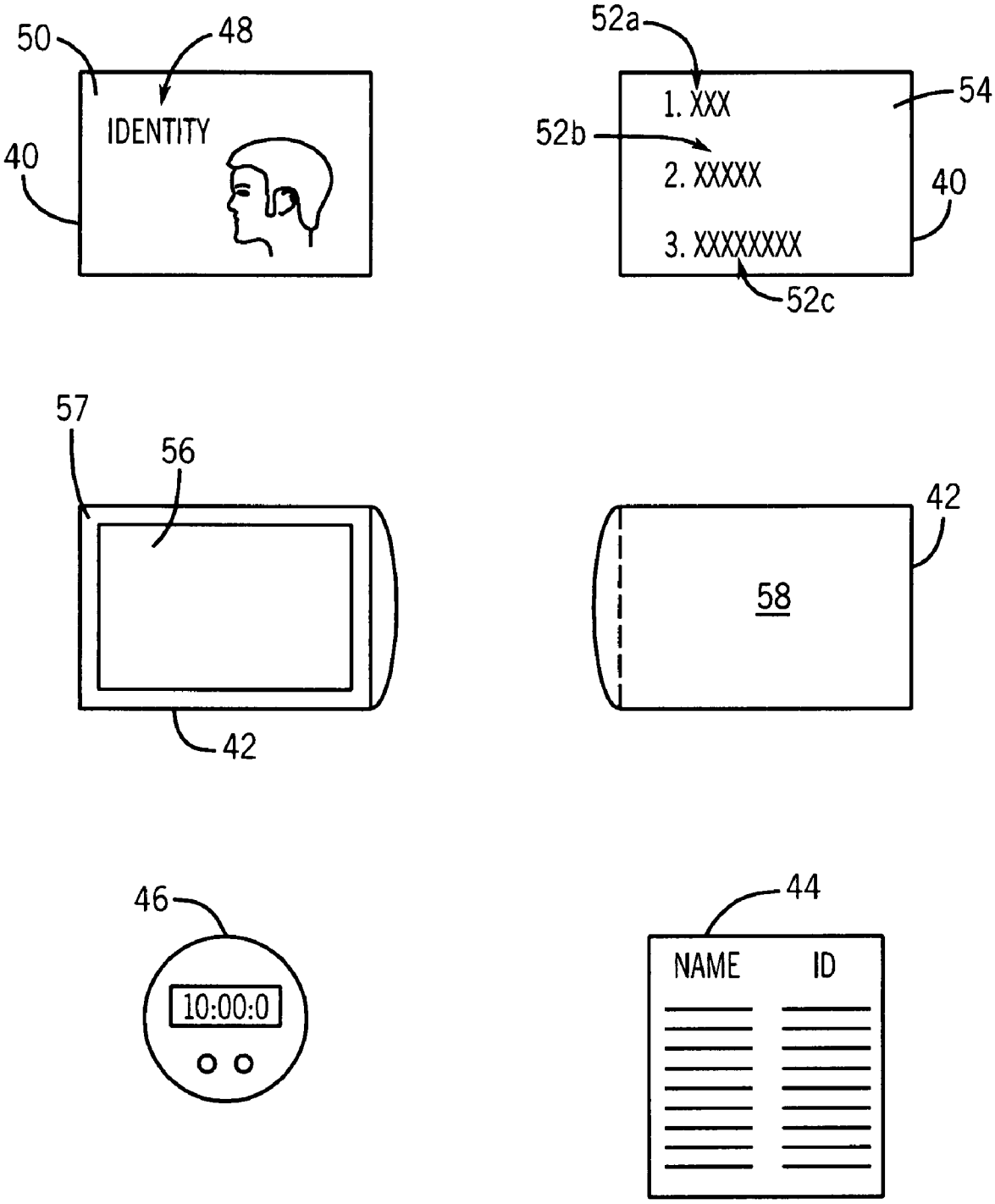
FIG. 6 shows another example of a game card and game playing accessories in accordance with the teachings of the present invention.
Figure 7:
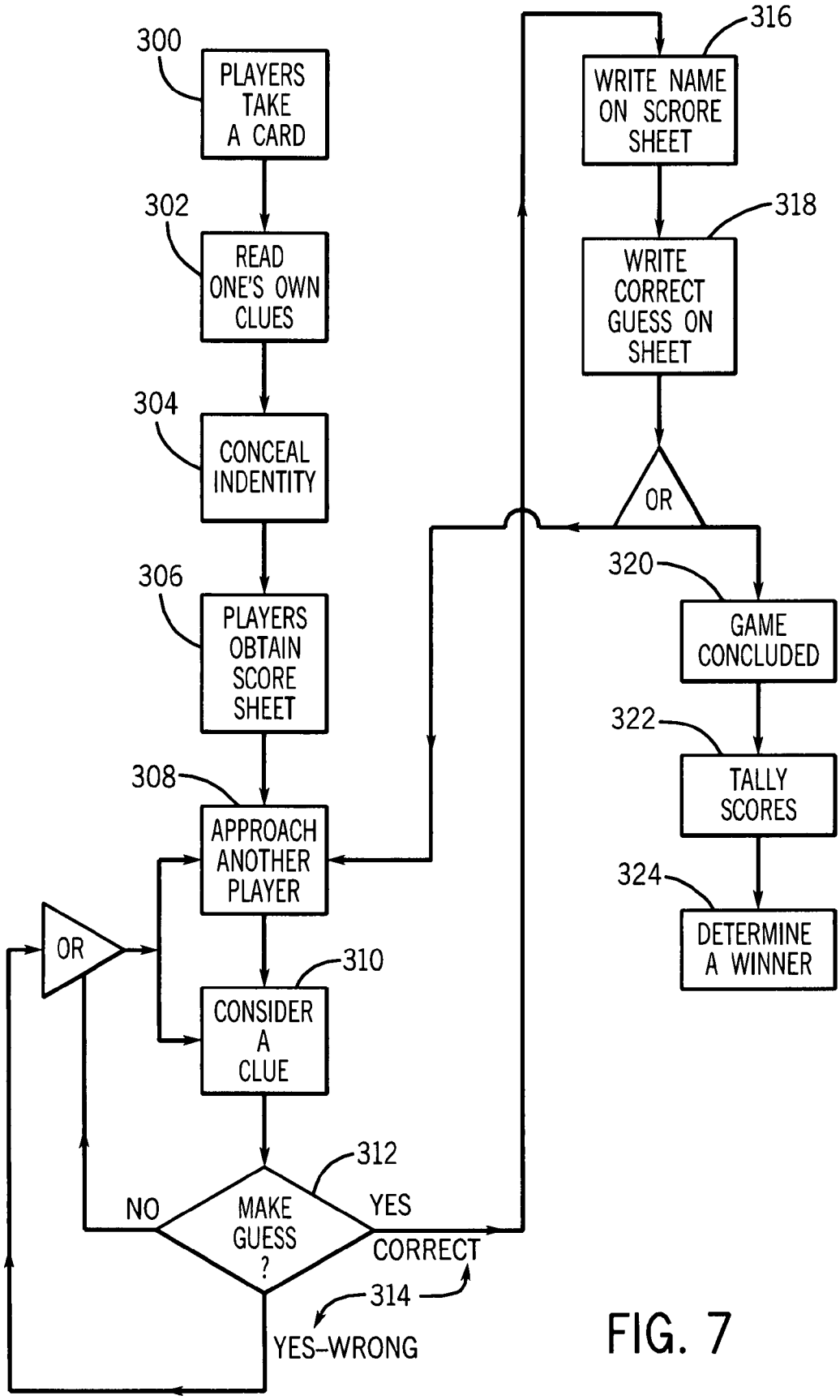
FIG. 7 is a flow chart showing another example of a method of playing a game using the card and score sheets of FIG. 6.

Another alternative example of a game and method of playing is shown in FIGS. 6 and 7. Referring to FIG. 6, the game in this example includes a plurality of identity cards 40, a plurality of card holders 42, a plurality of score sheets 44, and a game timer device 46. If provided, the type of game timer device 46 can vary without departing from the spirit and scope of the present invention and can be an hourglass, a clock, a mechanical timer, a digital timing device, or the like. In this example, each identity card 40 has the name of or an identity descriptor 48 for a person, place, or thing imprinted on one face 50 of the card and has a set of hints or clues 52 printed on the opposite face 54 of the card. The card holders 42 can be designed to include a window or opening 56 placed so as to reveal only the hints or clues 52 on a card 40, while hiding or concealing the identity 48 on the card. In this example, one side of the holder 42 has the window 56 to reveal the hints or clues 52 and the other side of the holder is opaque to conceal the name or identity 48. In an alternate example suited for the card 20 of FIG. 1, a holder can be provided having a window on one side that is sized and configured to reveal only the clues 26 while hiding the name or identity 24 that is printed on the same side of the card 20.

As depicted in FIG. 7, each player is again assigned a secret identity, as depicted at block 300, by drawing an identity card 40 from the set of identity cards having a particular identity theme. After memorizing the identity 48 printed on the first side 50 of their selected card 40 and reading the hints or clues 52 on the other side 54 of their card according to block 302, each player then conceals his or her identity card by inserting it into the holder 42 according to block 304. If the optional holders are not employed, the user can conceal their card in another suitable manner as desired. Each player then obtains a score sheet 44 per block 306 and is ready to play the game.

Play begins by each player approaching and/or being approached by other players as noted at block 308. Players ask each other for hints or clues as to each player's secret identity as indicated at block 310. Upon being asked, a player then reads or remembers and states one of the several hints or clues 52*a*, 52*b*, 52*c*, etc. imprinted on the second side of their selected identity card 40 without revealing their secret identity 48. The asking player may then either make a guess as to the other player's identity or request another clue as noted at block 312. The player can continue until there are no more clues on the card to be revealed. In one example not shown, the asking player can silently guess the other player's secret identity, write down the other player's real name on their score sheet 44, and then write down their guess, whether right or wrong, as to the other player's identity. As noted above, the player can also write down the number of clues it took before making their guess, if the number of clues is optionally used for scoring purposes.

In another example as shown, the asking player can verbally guess the other player's identity and the other player can confirm or deny the guess according to block 314. This could be done after each clue is given or only once when the asking player believes they know the correct answer. The asking player can then write down the other player's correct name according to block 316, and their actual secret identity, but only if they guessed correctly according to block 318. Again, the number of clues could also be recorded if used for scoring purposes. Upon making an incorrect guess in such an example, a player could either request another hint or clue 52*a*, 52*b*, 52*c*, etc. from the same player per block 314, or be required to move on to another player per block 308.

In either example, once the guessing and recording steps are complete between particular players, each of the players will then approach a different player and begin the guessing process again at block 308. These steps are repeated until a target number of guesses is reached or until a time limit for play is reached per block 320. The target number of guesses can be either all of the identities of participating players or a chosen number fewer than all of the participants.

At the end of play, the scores can be tallied and verified per block 322, a winner can be determined, and then the game ends per block 324. Scoring can be done in a number of optionally different ways as noted above. Scoring can simply tally the number of correct guesses for each player. Scoring can alternatively include some combination or percentage using the number of other players approached and the number of correct guesses for each participant. Scoring can also incorporate how few clues or hints 52 that a player required in making their guesses.

In all of the above disclosed examples of game playing methods, at least two players are encouraged to exchange hints, clues, and guesses with one another. Thus, the game can be used to promote mixing and mingling among the players. However, individual players can use the game cards or other media, as described below, to have fun and to learn.

Themes for the sets of identity cards can be derived from a myriad of sources as noted previously. Game card themes can be random or can be virtually any type of related theme based on persons, places, events, or things. Other than those mentioned as examples above, the themes can also include, but are certainly not limited to, famous criminals, occupations, political figures, technologies, endangered species, notorious or corrupt events or people, gossip subjects, sports statistics, and the like.

One of many possible variations of play for the disclosed game can include using more than one set or category of theme cards at a time. Using more than one set would allow play to accommodate a large number of players or merely add greater interest or complexity for the participants.

Each set of identity cards can include a plurality of cards with identities that are either randomly unrelated to one another or related to one another by a given theme or subject matter. Each set can include a substantial number of identity cards to allow participation of a large number of players for one game or a smaller number of players for many rounds of play.

Figure 8:
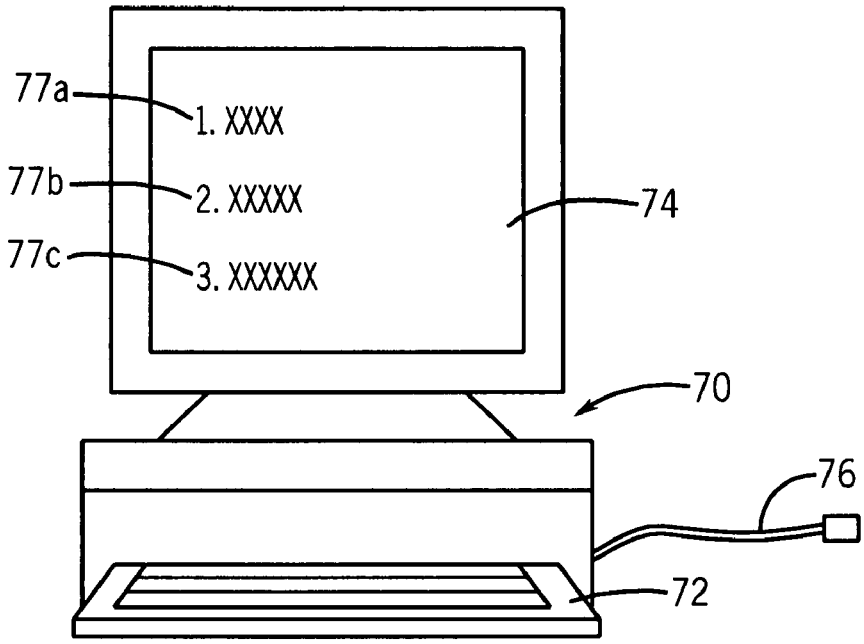
FIG. 8 shows one example of an electronic device with a display screen and a keyboard configured to play a game in accordance with the teachings of the present invention.

In another example, the disclosed games can also be played using different media, other than cards, such as utilizing the internet or a stand alone computer or other electronic device. As shown in FIG. 8, an electronic device such as a computer 70 can be provided having a user input such as a conventional keyboard 72 and display screen or monitor 74. In this example, the keyboard 72 can be used by a player or players to manipulate and play the game and input information to the computer while playing the game. The display screen 74 can be used to replace the cards as previously described to display information relevant to playing the game. In particular, the display screen 74 can be employed to illustrate an identity 76, clues 77*a*, 77*b*, and 77*c*, and the like, as shown. The display screen 74 can also be utilized to keep score, to provide game instructions, to act as the game board providing altering instructions, and the like.

Figure 9:
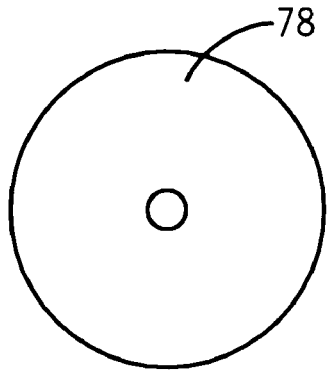
FIG. 9 shows one example of an electronic media that can be inserted into an electronic device for playing a game, such as the device of FIG. 8.

In one example, the computer can be connected to the internet with a game playing site accessed on the internet utilizing the computer 70. The site can be an interactive site with a game playing program accessible using a dedicated site address as is known. In another example, the game data can be programmed software that resides directly on the computer's hard drive. In another example as shown in FIG. 9, an external or portable storage media 78, such as a CD, DVD, or memory stick, can be inserted into an alternate drive of the computer and the game can be played utilizing the computers alternate drive without accessing an external site or burdening the computer's hard drive. Thus, the computer can have an internet connection 79 for playing the game utilizing an internet site or a hard drive to receive the external storage media 78 in order to play the game on the computer 70.

Use of an external media such as a CD or DVD allows the game to be easily carried for play virtually anywhere that there is an appropriate electronic device. The CD's or DVD's can be provided with one or more categories of identities and clues. Optional additional CD's and DVD's can be provided with different categories. Thus, the media products can be purchased with specific aims or goals in mind. As an example, a science CD can be sold separately from a history CD and the like.

Figure 10:
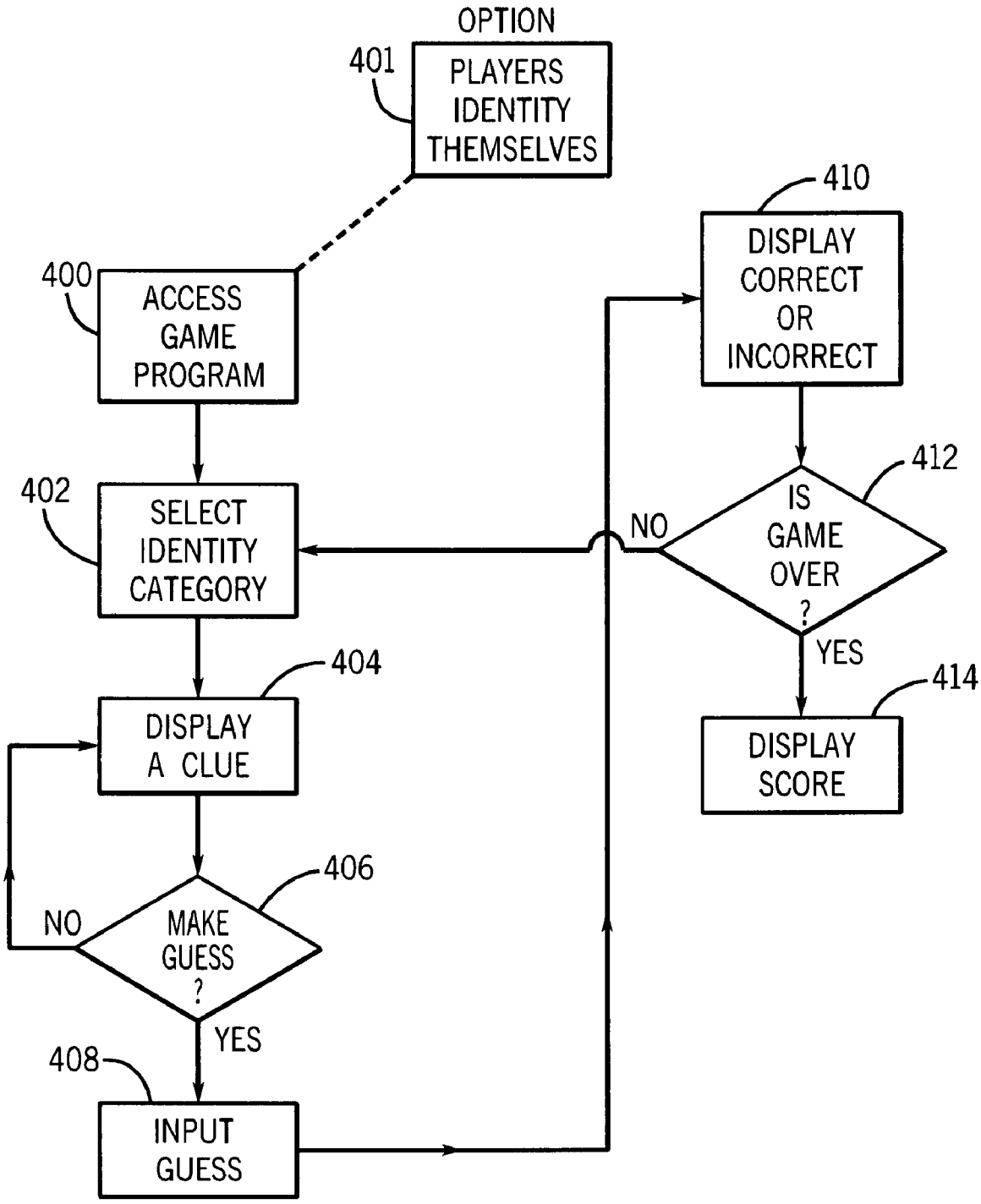
FIG. 10 is a flow chart showing one example of a method of playing a came suitable for use with the electronic device shown in FIG. 8.

Many alternate game playing methods can be used when playing via an electronic device. FIG. 10 depicts one possible game playing method utilizing an electronic source such as a computer. One or more individuals can play the game on the computer. If more than one player is playing, the players can take turns and the game program can be configured to switch among the players and to retain each player's ongoing game results as requested. A game can be played similar to the previously described games where each player selects an identity and the other player or players try to guess their identity. A computer can be used in a classroom or educational environment to play the game in a manner described above for FIG. 5 as well.

With reference to FIG. 10, another example of a method of playing a game includes first sitting at the computer 70 and accessing the game program using the keyboard 72 per block 400. Each of the one or more players can identify themselves in the program is desired per block 401, if the game is set up to compare scores between players or to retain scores for comparison to later games played. A first player can select an identity category for play per block 402. Alternatively, the device can be programmed to select the category or the device can be used with a CD or other media that has a predetermined identity category or categories available for play.

In this example, the program can then display one clue 77*a* to the first player per block 404. Upon receiving the clue, the player can then make a decision whether to try and guess the identity 76 or to request another clue, such as 77*b*, as indicated at block 406. If another clue is requested and available, the computer will display a new clue returning to block 404. If no more clues are available, the computer can display instructions for the player to make a guess. If another clue 77*b* is available, the player can consider the next clue and then determine if they are ready to guess the identity or to request another clue per block 406. Once a player is ready or is required to make a guess, the player can input their guess using the keyboard 72 per block 408. The computer can then indicate to the player whether their guess is correct or incorrect per block 410. Alternatively, the computer can simply move on with the game and only indicate a final score at the end of play. The player can then move on to the next identity and clues, or another player can take a turn.

In one example, the lone player can continue by receiving another clue for a new identity per block 404. The game can continue as before through blocks 404-410. Per block 412, the game can terminate at a time limit, an end of an identity category, a predetermined number of categories, or the like. The game program can then reveal the lone player's score on the screen 74 per block 414. As with the other examples, the score can simply be the number of correct guesses, a percentage of correct guesses or a points total calculated using one or more playing parameters, such as correct guesses and number of clues given.

In an alternative example with multiple players, the computer can present a clue for a new identity for a different player to take a turn. The game program can be figured to keep multiple scores for multiple players as the game progresses. The game program can also be configured to determine an overall winner by identifying the player with the most points, most correct guesses, or the like. The game program can also be configured to retain old scores by specific players or by aggregate high score to rank a player's current score against others. The disclosed electronic game playing methods can vary from the example described in FIG. 10 or in the earlier examples described in FIGS. 4, 5, and 7. For example, the number of clues given for each identity or for each category can be the same all the time or can be varied, depending on the difficulty of a particular category or a player's choice. Points can be rewarded as a result of the number of clues chosen and/or taken.

Figure 11:
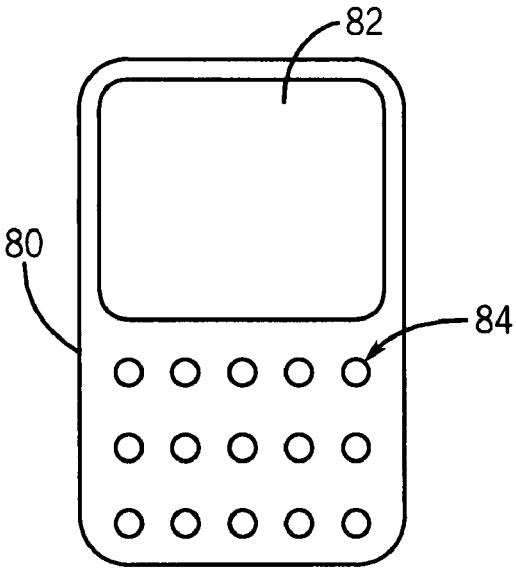
FIG. 11 shows another example of an electronic device configured for use in playing a game in accordance with the teachings of the present invention.

The computer 70 described above can be replaced by other electronic devices such as handheld game playing units, telephones, or other handheld communication devices. A game program can be stored on the device or the device can be configured to wirelessly connect to a remote game site and be played on the device in accordance with the teachings of the present invention. In one example shown in FIG. 11, a handheld electronic device 80 has a small display screen 82 and an input device 84 such as a plurality of buttons, a joystick, and/or a small, full function keypad. The game can be played in an identical manner to that described above with respect to the computer, but on the smaller electronic device. The particular electronic devices disclosed and described herein are not intended to be limiting. The device used to store and play the game program can vary considerably and yet fall within the spirit and scope of the present invention. In another example, multiple players can communicate with one another using handheld electronic devices to play a game in accordance with the teachings of the present invention. A game could be played similar to those described above with reference to FIGS. 4, 5, and 7, but using the devices instead of the cards and sheets. The game program can be configured to accommodate multiple players using multiple discrete devices, which in one example wirelessly upload and download to and from a common game site.

The media for the games disclosed herein can be audible and not visual or can employ both an audio and a visual component. The games can thus employ or interact with a component that can emit audible clues to the players. Also, the identities and clues need not be words or sentences. It is within the scope and spirit of the present invention that the clues, the identities, or both can be non-word images or the like. Additionally, more than one media can be employed in a game according to the invention. For example, cards can be used in conjunction with an audio device or an electronic device with a display screen to play an identity game in accordance with the teachings of the present invention.

Although certain games and methods of play have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. An identity guessing game for a plurality of players comprising:

a plurality of identities to be guessed being provided on a media in a manner permitting each of the plurality of players to select and conceal a different one of the plurality of identities and to retain the selected identity for a round of play;

a plurality of clue sets each having multiple clues relating to a respective one of the identities, each clue set being provided on a media so as to be presentable one clue at a time to each of the other of the plurality of players during the round of play; and a score keeping mechanism configured for each of the plurality of players to enter a name of the plurality of players during the round of play and to enter their identity guess as to the selected identity concealed by each of the plurality of players, whereby the number of correct identity guesses by each of the plurality of players can be tabulated at the end of the round of play.

2. An identity guessing game according to claim 1, wherein the media comprises a plurality of cards wherein each card includes one of the plurality of identities visible on a surface of the respective card.

3. An identity guessing game according to claim 1, wherein the media comprises a plurality of cards wherein each card includes one of the plurality of clue sets visible on a surface of the respective card and wherein each player holds one of the plurality of cards during the round of play that includes the clue set for their selected identity.

4. An identity guessing game according to claim 3, wherein each card includes one of the plurality of identities visible on a surface of the respective card, the one identity being related to the set of clues on the card.

5. An identity guessing game according to claim 4, wherein the one identity and the one clue set are provided on the same surface of the card.

6. An identity guessing game according to claim 4, wherein the one identity is visible on one surface of the card and the one clue set is visible on an opposite surface of the card.

7. An identity guessing game according to claim 1, wherein the media is an electronic media utilizing a stored game program including the plurality of identities and the plurality of clue sets.

8. An identity guessing game according to claim 7, wherein the electronic media is a computer with a keyboard and a display screen.

9. An identity guessing game according to claim 8, wherein the electronic media further includes a compact disc or a digital video disc carrying the stored game program and insertable into a drive of the computer for play.

10. An identity guessing game according to claim 7, wherein the electronic media is a handheld device having the game program stored on-board the handheld device.

11. An identity guessing game according to claim 1, wherein the score keeping mechanism includes a plurality of score sheets, one for each of the plurality of players, each having a region to input the name of each of the plurality of players participating in the identity guessing game, a region to input the respective identity guess corresponding to each name, and a point value for each correct identity guess.

12. An identity guessing game according to claim 1, wherein the scoring mechanism is further configured for each of the plurality of players to enter the number of clues received prior to guessing the selected identity of each of the other of the plurality of players.

13. An identity guessing game according to claim 12, wherein the scoring mechanism further includes a region to input a point value for each correct identity guess based on the number of clues received for each correct identity guess.

* * * * *